US011587719B2

(12) United States Patent
Liang et al.

(10) Patent No.: US 11,587,719 B2
(45) Date of Patent: Feb. 21, 2023

(54) MAGNETIC INTEGRATED HYBRID DISTRIBUTION TRANSFORMER

(71) Applicant: XI'AN JIAOTONG UNIVERSITY, Shaanxi (CN)

(72) Inventors: Deliang Liang, Shaanxi (CN); Yibin Liu, Shaanxi (CN); Yang Liang, Shaanxi (CN); Mingkang Zhang, Shaanxi (CN); Qixu Chen, Shaanxi (CN); Guanhua Sun, Shaanxi (CN); Peixin Jia, Shaanxi (CN)

(73) Assignee: XI'AN JIAOTONG UNIVERSITY, Shaanxi (CN)

( * ) Notice: Subject to any disclaimer, the term of this patent is extended or adjusted under 35 U.S.C. 154(b) by 531 days.

(21) Appl. No.: 16/758,403

(22) PCT Filed: Dec. 5, 2017

(86) PCT No.: PCT/CN2017/114668
§ 371 (c)(1),
(2) Date: Apr. 23, 2020

(87) PCT Pub. No.: WO2019/085140
PCT Pub. Date: May 9, 2019

(65) Prior Publication Data

US 2020/0286675 A1 Sep. 10, 2020

(30) Foreign Application Priority Data

Nov. 1, 2017 (CN) ..... 201711059857.0

(51) Int. Cl.
*H01F 27/24* (2006.01)
*H01F 27/28* (2006.01)
(Continued)

(52) U.S. Cl.
CPC ..... *H01F 27/2804* (2013.01); *H01F 27/2455* (2013.01); *H01F 27/40* (2013.01)

(58) Field of Classification Search
CPC .. H01F 27/2804; H01F 27/2455; H01F 27/40; H01F 3/12; H01F 27/38;
(Continued)

(56) References Cited

U.S. PATENT DOCUMENTS 4,166,992 A * 9/1979 Brueckner ..... H01F 29/146 336/155
6,166,531 A * 12/2000 Hogan ..... H01F 3/12 323/361

FOREIGN PATENT DOCUMENTS

CA 2829807 A1 * 9/2012 ..... H01F 27/28
CN 112803788 A * 5/2021 ..... H01F 27/24

* cited by examiner

*Primary Examiner* — Tuyen T Nguyen

(57) ABSTRACT

A magnetic integrated hybrid distribution transformer includes a main transformer, a series isolation transformer and a converter, wherein: an iron core includes an iron beam unit, an iron yoke unit and a leakage magnetic core unit. The main transformer includes secondary windings, primary windings and control windings all of which are layer-windings and wound around main transformer iron beams. The series isolation transformer includes converter side windings and grid side windings all of which are pancake-windings and wound around isolation transformer iron beams. The converter side windings and the control windings are respectively connected with the converter by the star connection with neutral point. Leakage magnetic cores are respectively inserted between the primary windings and the control windings or between the converter side windings and the grid side windings, so as to achieve magnetic integration design of the transformer and output connection inductor of the converter.

11 Claims, 4 Drawing Sheets

(51) Int. Cl.
*H01F 27/245* (2006.01)
*H01F 27/40* (2006.01)

(58) Field of Classification Search
CPC ..... H01F 30/12; H01F 27/24; H01F 27/28; H01F 27/306
See application file for complete search history.

MAGNETIC INTEGRATED HYBRID DISTRIBUTION TRANSFORMER

CROSS REFERENCE OF RELATED APPLICATION

This is a U.S. National Stage under 35 U.S.C. 371 of the International Application PCT/CN2017/114668, filed Dec. 5, 2017, which claims priority under 35 U.S.C. 119(a-d) to CN 201711059857.0, filed Nov. 1, 2017.

BACKGROUND OF THE PRESENT INVENTION

Field of Invention

The present invention relates to a magnetic integrated hybrid distribution transformer, which belongs to a field of transformer technology.

Description of Related Arts

In recent years, the upgrading process of the smart distribution network has been accelerating. The traditional distribution transformer has simple structure, reliable operation and good economy. However, its controllability is limited, and it cannot satisfy the future development trend of the smart distribution network. Therefore, the research on the new controllable distribution transformers has gradually become a hot research topic. Under such circumstances, experts at the ABB Institute, the University of Zielona Góra, and Instituto Superior Técnico proposed the concept of hybrid distribution transformer. The so-called hybrid distribution transformer is a new type of controllable distribution transformer realized by combining the traditional distribution transformer and the highly controlled converters. Compared with the traditional distribution transformer, hybrid distribution transformer not only inherits the advantages of high efficiency and reliability that the traditional distribution transformer has, but also has much higher controllability than the traditional distribution transformers. Hybrid distribution transformer is very suitable for the development of the future smart distribution network.

However, the existing research on hybrid distribution transformers is still not complete, the system contains a large number of discrete magnetic components, such as main transformer, series isolation transformer, and output connection inductors of the converter. The excessive discrete magnetic components increase the volume of the whole iron core, and make the overall structure of the system very complicated, which will not only cause large losses, but also lead to a large waste of ferromagnetic materials.

In order to reduce the number of discrete magnetic components and improve the utilization rate of ferromagnetic materials, related reports propose to disassemble the isolation transformer and windings, so as to realize the decoupling magnetic integration design of the main transformer and the isolation transformer of the hybrid distribution transformer. Furthermore, to realize the magnetic integrated design of the transformer and the output connection inductor of the converter, the output connection inductor of the converter is disassembled and reversely wound around the transformer iron beams in series. The related report states that the existing magnetic integrated design of the discrete magnetic components in the system are realized, and the control performance of the hybrid distribution transformer is not changed. However, in this design, the structure of the whole iron core and the winding arrangement are very complicated. Moreover, the output connection inductor is replaced by the leakage inductor that realized by multi-reverse series windings, the number of windings is too large, and the coil volume is large, thereby affecting the practicability.

SUMMARY OF THE PRESENT INVENTION

In view of the deficiencies of the existing work, a magnetic integrated hybrid distribution transformer with simple structure is proposed in the present invention. Specifically, the proposed magnetic integrated hybrid distribution transformer can realize the integrated design of discrete magnetic parts of the system without changing the basic control functions of the original hybrid distribution transformer with discrete magnetics, thereby effectively reducing the number of discrete magnetic components and the total volume of the device, and improving the utilization of ferromagnetic materials.

To achieve the above object, the present invention adopts the following technical solutions.

A magnetic integrated hybrid distribution transformer comprises a main transformer, a series isolation transformer and a converter, wherein: both the main transformer and the series isolation transformer comprise an iron core and windings; the iron core comprises an iron beam unit, an iron yoke unit and a leakage magnetic core unit; the iron beam unit comprises three main transformer iron beams that longitudinally arranged in parallel with each other and three isolation transformer iron beams that transversely arranged connect with each other; the iron yoke unit comprises a transversely arranged bottom iron yoke, a transversely arranged middle iron yoke and four connection iron yokes that longitudinally distributed in parallel with each other; the leakage magnetic core unit comprises four control winding leakage magnetic cores that longitudinally distributed in parallel with each other and three converter side winding leakage magnetic cores that longitudinally distributed in parallel with each other; the windings comprise main transformer windings and series isolation transformer windings; in each phase, the main transformer windings are a control winding, a primary winding and a secondary winding, all of which are wound around a corresponding main transformer iron beam; in each phase, the series isolation transformer windings are a grid side winding and a convert side winding, both of which are wound around a corresponding isolation transformer iron beam; all the main transformer iron beams connect to the bottom iron yoke and the middle iron yoke; all connection iron yokes connect to the middle iron yoke and an end portion of the corresponding series isolation transformer iron beam; the main transformer iron beams and the isolation transformer iron beams form two main transformer windows and three series isolation transformer windows by sharing the middle iron yoke; each of the control winding leakage magnetic cores is inserted between the primary winding and the control winding; with the help of the leakage magnetic core unit, original output connection inductors are neglected, thereby integrating the original current output connection inductors and the main transformer together; each of the converter side winding leakage magnetic cores is inserted between the grid side winding and the convertor side winding, thereby integrating the original voltage output connection inductors and the series isolation transformer together. The converter connects to the control winding and the converter side winding.

In each phase, the primary winding connects to the grid side winding in series, then three grid side windings connect to a power grid by a star connection with neutral point. In each phase, the secondary winding supplies a load by a three-phase four-wire method. Three control windings and three converter side windings connect with the converter by the star connection with neutral point.

The converter comprises three current bridge arms, three voltage bridge arms, a zero sequence bridge arm and a DC-link (direct current-link) capacitor. The three control windings connect to middle points of the three current bridge arms, respectively. The three converter side windings connect to middle points of the three voltage bridge arms, respectively. Middle points of the three control windings and the three converter side windings connect to a middle point of the zero sequence bridge arm. All of the three current bridge arms, the three voltage bridge arms and the zero sequence bridge arm connect to the DC-link capacitor in parallel.

All of secondary windings, primary windings and control windings are layer-windings and wound around the main transformer iron beam from inside to outside concentrically. The converter side windings and grid side winding are pancake windings and wound around the isolation transformer iron beam from left to right concentrically.

The main transformer iron beams and the isolation transformer iron beams connect together by the iron yokes. Specifically, a bottom end of the main transformer iron beams connects to the bottom iron yoke, and an upper end of the main transformer iron beams connects to the middle iron yoke. A left end and a right end of the isolation transformer iron beams connect to an upper end of the four connection iron yokes, sequentially. An end of the two adjacent isolation transformer iron beams share a common connection iron yoke. A bottom end of the four connection iron yokes connects to the middle iron yoke. Thereby, the main transformer and the series isolation transformer share the middle iron yoke, so as to achieve weak coupling integration.

The phase shift is applied in the arrangement of the main transformer windings and the series isolation transformer windings to avoid peak flux stacking in the middle iron yoke. By doing so, the utilization of material ferromagnetic materials can be increased. Specifically, the main transformer windings are wound around three main transformer iron beams in the order of phase-A, phase-B and phase-C from left to right, respectively. The series isolation transformer windings are wound around three isolation transformer iron beams in the order of phase-C, phase-B and phase-A from left to right, respectively. The iron core is constructed with the silicon steel sheet, and the 45-degree connection is applied to connect the iron beams and the iron yokes. The diameter of the main transformer iron beams is larger than that of the isolation transformer iron beams, and the diameter of the bottom iron yoke and the middle iron yoke is larger than that of the connection iron yokes.

Air gaps between the main transformer leakage magnetic cores and the middle/bottom iron yokes are adjustable, and air gaps between the isolation transformer leakage magnetic cores and the middle iron yoke/the isolation transformer iron beams are adjustable too. The control windings are elliptic or semi-elliptic.

Compared with the existing works, the present invention has beneficially technical effects as follows.

With the help of the magnetic integration technology, such as providing the leakage magnetic cores, sharing the middle iron yoke and setting the connection iron yokes, the magnetic integrated design of the main transformer, the series isolation transformer and the output connection inductors is realized, thereby greatly reducing the number of discrete magnetic components in the hybrid distribution transformer, reducing the number of turns of the winding, and simplifying the structure of the discrete system.

Further, the present invention can also shift the peak time of the magnetic flux by the phase shifting arrangement of the windings, and can effectively reduce the cross-sectional area of the middle iron yoke, thereby improving the utilization ratio of the ferromagnetic materials.

BRIEF DESCRIPTION OF THE DRAWINGS

FIG. 1(*b*) is a schematic diagram of circuit topology and connection relationship of a converter of the magnetic integrated hybrid distribution transformer provided by the present invention.

FIG. 1(*c*) is a schematic diagram of circuit topology and connection relationship of a filter of the magnetic integrated hybrid distribution transformer provided by the present invention.

FIG. 4(*b*) is a right view of the magnetic integrated hybrid distribution transformer provided by the present invention.

FIG. 4(*c*) is a top view of the magnetic integrated hybrid distribution transformer provided by the present invention.

DETAILED DESCRIPTION OF THE PREFERRED EMBODIMENT

The present invention is further described according to the schematic diagrams as follows. It should be understood that the schematic diagrams described herein are merely illustrative for the present invention and are not intended to limit the present invention.

Figure 1A:
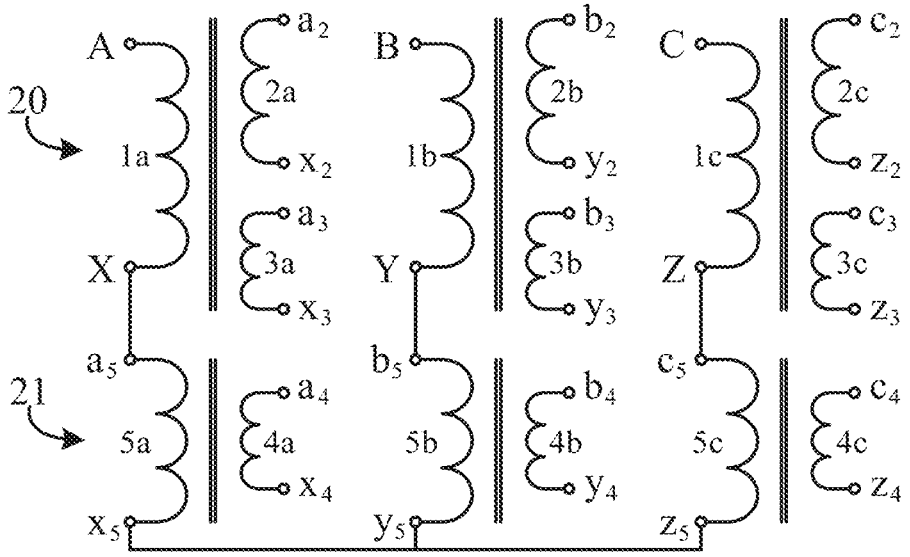
FIG. 1(*a*) is a schematic diagram of circuit topology and connection relationship of a main transformer and a series isolation transformer of a magnetic integrated hybrid distribution transformer provided by the present invention.
Figure 1B:
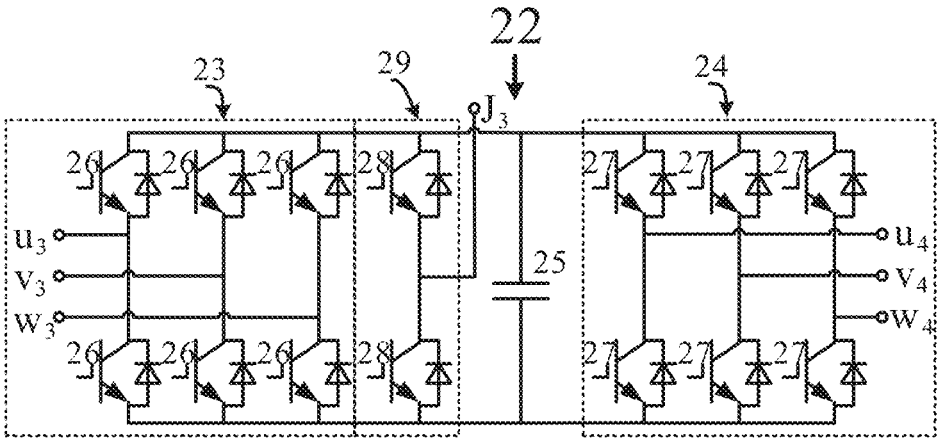
Figure 1C:
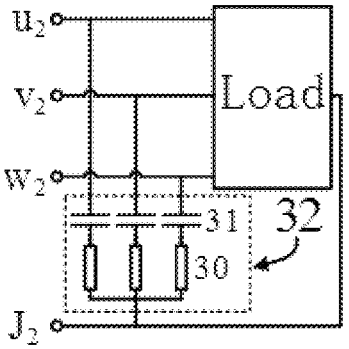

Referring to FIG. 1, the main parts of the magnetic integrated hybrid distribution transformer in this present invention is illustrated. Specifically, the magnetic integrated hybrid distribution transformer comprises a main transformer 20, a series isolation transformer 21, a converter 22 and a filter 32. As shown in FIG. 1(*a*), the main transformer 20 comprises a phase-A primary winding 1*a*, a phase-B primary winding 1*b*, a phase-C primary winding 1*c*, a phase-A secondary winding 2*a*, a phase-B secondary winding 2*b*, a phase-C secondary winding 2*c*, a phase-A control winding 3*a*, a phase-B control winding 3*b* and a phase-C control winding 3*c*. A beginning terminal and an end terminal of the phase-A primary winding are denoted as A and X, respectively. A beginning terminal and an end terminal of the phase-B primary winding are denoted as B and Y, respectively. A beginning terminal and an end terminal of the phase-C primary winding are denoted as C and Z, respectively. A beginning terminal and an end terminal of the phase-A secondary winding are denoted as $a_2$ and $x_2$, respectively. A beginning terminal and an end terminal of the Phase-B secondary winding are respectively denoted as $b_2$ and $y_2$. A beginning terminal and an end terminal of phase-C secondary winding are denoted as $c_2$ and $z_2$, respectively. A beginning terminal and an end terminal of the Phase-A control winding are denoted as $a_3$ and $x_3$, respectively. A beginning terminal and an end terminal of the Phase-B control winding are denoted as $b_3$ and $y_3$, respectively. A beginning terminal and an end terminal of the Phase-C control winding are denoted as $c_3$ and $z_3$, respectively. The series isolation transformer 21 comprises a Phase-A grid side winding 5*a*, a Phase-B grid side winding 5*b*, a Phase-C grid side winding 5*c*, a Phase-A converter side winding 4*a*, a Phase-B converter side winding 4*b* and a Phase-C converter side winding 4*c*. A beginning terminal and an end terminal of the Phase-A grid side winding are denoted as $a_5$ and $x_5$, respectively. A beginning terminal and an end terminal of the Phase-B grid side winding are denoted as $b_5$ and $y_5$, respectively. A beginning terminal and an end terminal of the Phase-C grid side winding are denoted as $c_5$ and $z_5$, respectively. A beginning terminal and an end terminal of the Phase-A converter side winding are denoted as $a_4$ and $x_4$, respectively. a beginning terminal and an end terminal of the Phase-B converter side winding are denoted as $b_4$ and $y_4$, respectively. A beginning terminal and an end terminal of the Phase-C converter side winding are denoted as $c_4$ and $z_4$, respectively. The primary winding connects with the grid side winding in series, and then connects to a power network by a star-connection with neutral point. Specifically, the beginning terminals A, B and C of the Phase-A primary winding 1*a*, the Phase-B primary winding 1*b* and the Phase-C primary winding 1*c* connect to the power network, while the end terminals X, Y and Z of the Phase-A primary winding 1*a*, the Phase-B primary winding 1*b* and the Phase-C primary winding 1*c* connect to the beginning terminals $a_5$, $b_5$ and $c_5$ of the Phase-A grid side winding 5*a*, the Phase-B grid side winding 5*b* and the Phase-C grid side winding 5*c*, respectively. The end terminals $x_5$, $y_5$ and $z_5$ of the Phase-A grid side winding 5*a*, the Phase-B grid side winding 5*b* and the Phase-C grid side winding 5*c* connect together and form a neutral point.

As shown in FIG. 1(*b*), the converter 22 comprises a three-phase current bridge arm unit 23 (which is formed by three bridge arms connected with each other in parallel), a three-phase voltage bridge arm unit 24 (which is formed by another three bridge arms connected with each other in parallel), a zero sequence bridge arm 29 and a DC-link capacitor 25. All bridge arms connect to the DC-link capacitor 25 in parallel. Each bridge arm of the three-phase current bridge arm unit 23 comprises two first power switches 26 connected with each other in series. Each bridge arm of the three-phase voltage bridge arm unit 24 comprises two second power switches 27 connected with each other in series. The zero sequence bridge arm 29 comprises two third power switches 28 connected with each other in series. Three middle points of three bridge arms of the three-phase current bridge arm unit 23 are the three current output ends of the converter 22, namely, $u_3$, $v_3$ and $w_3$ in FIG. 1(*b*), respectively. Three middle points of three bridge arms of the three-phase voltage bridge arm unit 24 are three voltage output ends of the converter 22, namely, $u_4$, $v_4$ and $w_4$ in FIG. 1(*b*), respectively. A middle point of the zero sequence bridge arm 29 is represented as $J_3$.

The control windings and the converter side windings connect to the converter 22 by the star connection with a neutral point. Specifically, the beginning terminal $a_3$ of the Phase-A control winding 3*a*, the beginning terminal $b_3$ of the Phase-B control winding 3*b*, and the beginning terminal $c_3$ of the Phase-C control winding 3*c* connect to the current output ends $u_3$, $v_3$ and $w_3$ of the converter 22, respectively. The beginning terminal $a_4$ of the Phase-A converter side winding 4*a*, the beginning terminal $b_4$ of the Phase-B converter side winding 4*b*, and the beginning terminal $c_4$ of the Phase-C converter side winding 4*c* connect to the voltage output ends $u_4$, $v_4$ and $w_4$ of the converter 22, respectively. The end terminal $x_3$ of the Phase-A control winding 3*a*, the end terminal $y_3$ of the Phase-B control winding 3*b*, the end terminal $z_3$ of the Phase-C control winding 3*c*, the end terminal $x_4$ of the Phase-A converter side winding 4*a*, the end terminal $y_4$ of the Phase-B converter side winding 4*b* and the end terminal $z_4$ of the Phase-C converter side winding 4*c* connect to the middle point $J_3$ of the zero sequence bridge arm 29 of the converter 22.

The secondary windings supply load by a three-phase four-wire method. Specifically, the beginning terminal $a_2$ of the Phase-A secondary winding 2*a*, the beginning terminal $b_2$ of the Phase-B secondary winding 2*b* and the beginning terminal $c_2$ of the Phase-C secondary winding 2*c* connected to three beginning terminals $u_2$, $v_2$, $w_2$ of the load, respectively. The end terminal $x_2$ of the Phase-A secondary winding 2*a*, the end terminal $y_2$ of the Phase-B secondary winding 2*b*, and the end terminal $z_2$ of the Phase-C secondary winding 2*c* connect to the middle point $J_2$ of the load.

As shown in FIG. 1(*c*), the filter 32 connects to the secondary windings in parallel by the star connection with neutral point. Specifically, each phase of the filter 32 comprises a filter capacitor 31 and a damping resistor 30 that connects to the filter capacitor 31 in series. Three beginning terminals of three phases of the filter 32 connect to $u_2$, $v_2$ and $w_2$, respectively. Three end terminals of the three phases of the filter 32 connect to the middle point $J_2$ of the load. The filter 32 can significantly reduce the higher harmonic content of the load voltage.

Figure 2:
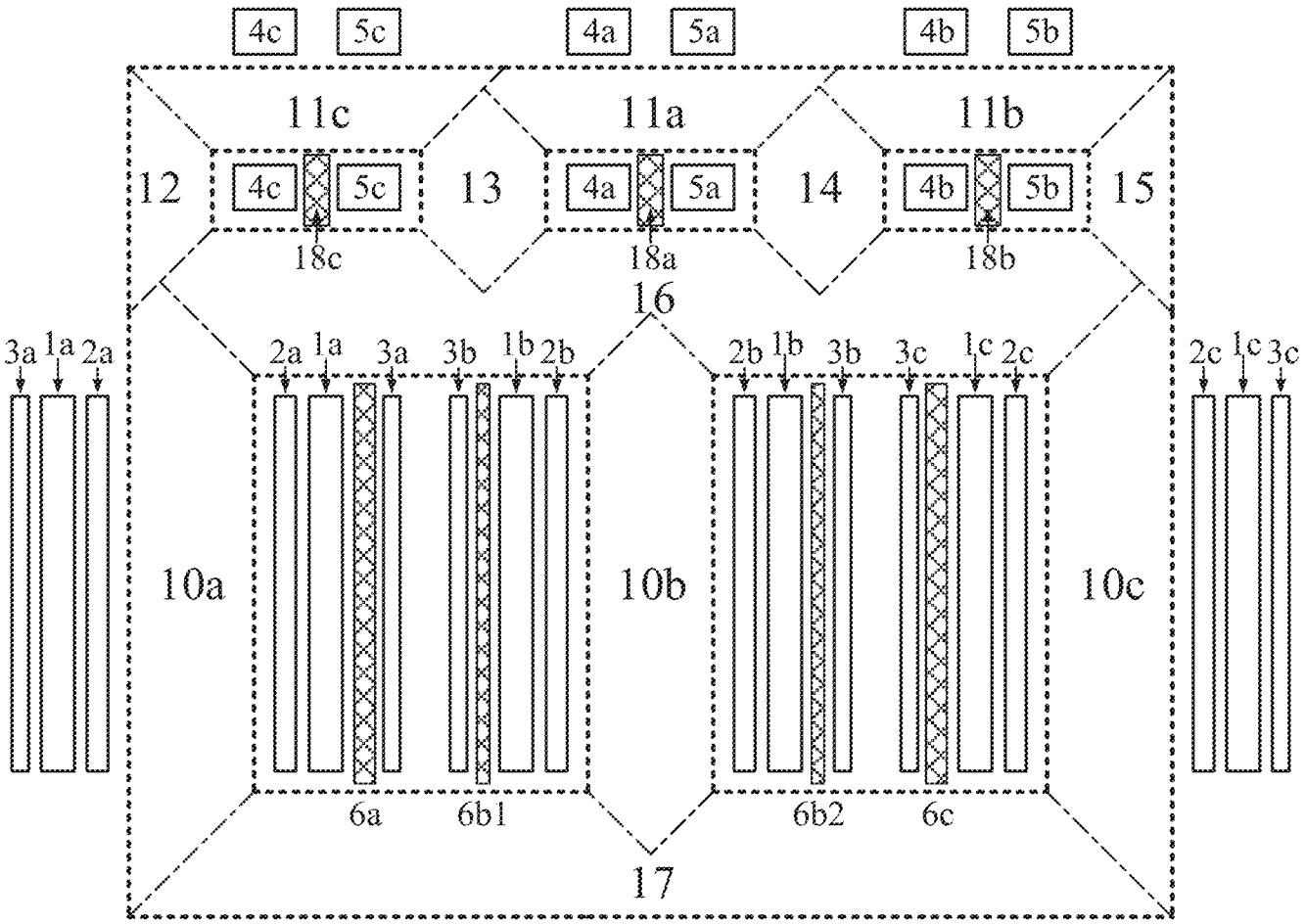
FIG. 2 is a schematic diagram of winding arrangement and a connection method of iron core lamination of the magnetic integrated hybrid distribution transformer provided by the present invention.
Figure 3:
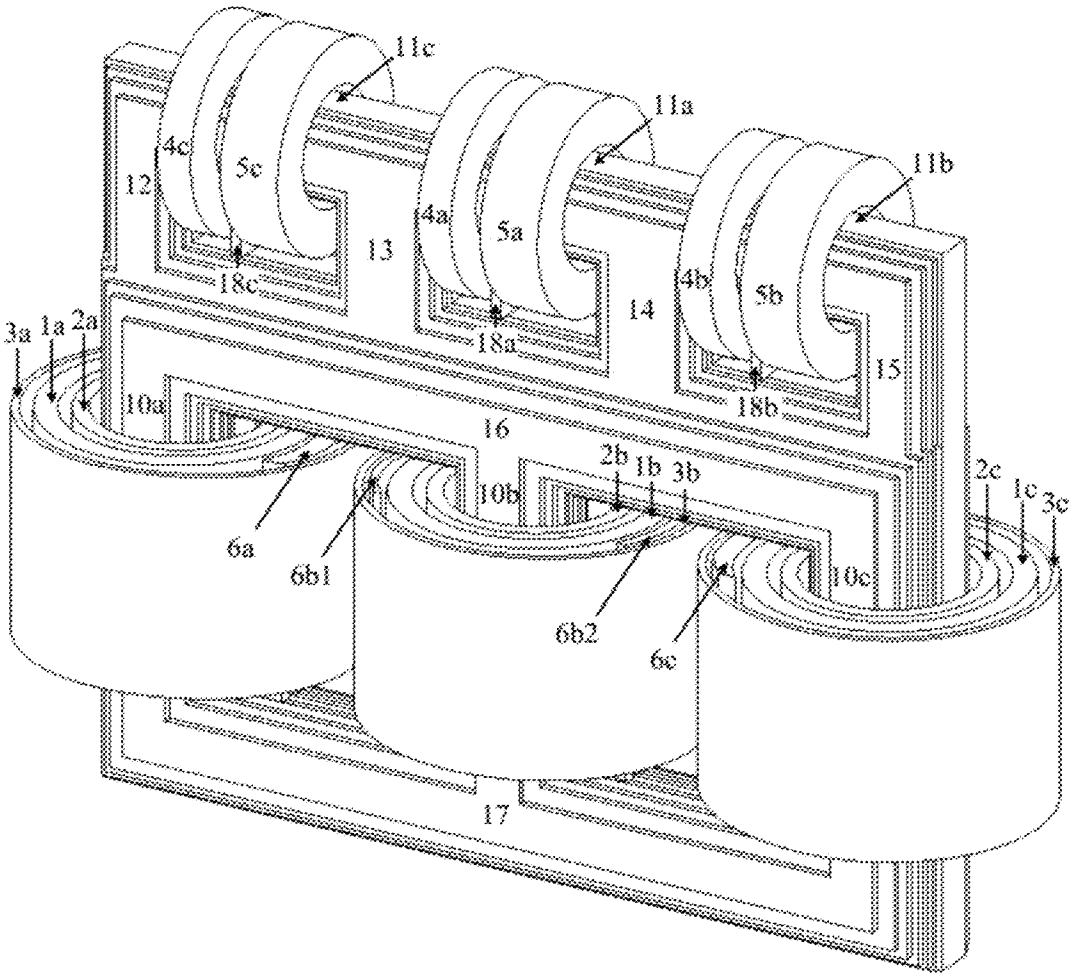
FIG. 3 is a three-dimensional schematic diagram of the magnetic integrated hybrid distribution transformer provided by the present invention.

Referring to FIG. 2 and FIG. 3, the iron core of the magnetic integrated hybrid distribution transformer comprises an iron beam unit, an iron yoke unit and a leakage magnetic core unit. In these two drawings, the iron beam unit comprises a Phase-A main transformer iron beam 10*a*, a Phase-B main transformer iron beam 10*b*, a Phase-C main transformer iron beam 10*c*, a Phase-A isolation transformer iron beam 11*a*, a Phase-B isolation transformer iron beam 11*b* and a Phase-C isolation transformer iron beam 11*c*. The iron yoke unit comprises a bottom iron yoke 17, a middle iron yoke 16, a Phase-C independent iron yoke 12, a C/A phase common iron yoke 13, an A/B phase common iron yoke 14 and a Phase-B independent iron yoke 15. The leakage magnetic core unit comprises a Phase-A main transformer leakage magnetic core 6*a*, a left Phase-B main transformer leakage magnetic core 6*b*1, a right Phase-B main transformer leakage magnetic core 6*b*2, a Phase-C main transformer leakage magnetic core 6*c*, a Phase-A isolation transformer leakage magnetic core 18*a*, a Phase-B isolation transformer leakage magnetic core 18*b* and a Phase-C isolation transformer leakage magnetic core 18*c*.

The Phase-A main transformer iron beam 10*a*, the Phase-B main transformer iron beam 10*b*, and the Phase-C main transformer iron beam 10*c* are longitudinally arranged in parallel from left to right. The upper ends of the Phase-A main transformer iron beam 10*a*, the Phase-B main transformer iron beam 10*b*, and the Phase-C main transformer iron beam 10*c* connect to a bottom end of the middle iron yoke 16. Bottom ends of the Phase-A main transformer iron beam 10*a*, the Phase-B main transformer iron beam 10*b* and the Phase-C main transformer iron beam 10*c* connect to the bottom iron yoke 17. The Phase-C isolation transformer iron beam 11*c*, the Phase-A isolation transformer iron beam 11*a* and the Phase-B isolation transformer iron beam 11*b* are horizontally arranged and connected with each other from left to right. An end of the Phase-C isolation transformer iron beam 11*c* connects to an upper end of the Phase-C independent iron yoke 12. Both the Phase-C isolation transformer iron beam 11*c* and the Phase-A isolation transformer iron beam 11*a* connect to an upper end of the C/A phase common iron yoke 13. Both the Phase-A isolation transformer iron beam 11*a* and the Phase-B isolation transformer iron beam 11*b* connect to an upper end of the A/B phase common iron yoke 14. An end of the Phase-B isolation transformer iron beam 11*b* connects to an upper end of the Phase-B independent iron yoke 15. As a result, the phase shifting arrangement of the main transformer and the series isolation transformer winding is achieved. Bottom ends of the Phase-C independent iron yoke 12, the C/A phase common iron yoke 13, the A/B phase common iron yoke 14 and the Phase-B independent iron yoke 15 connect to an upper end of the middle iron yoke 16.

The connection between the iron beams and the iron yokes is introduced as follows. A left end of the bottom iron yoke 17 connects to the bottom end of the Phase-A main transformer iron beam 10*a*, a middle portion of the bottom iron yoke 17 connects to a bottom end of the Phase-B main transformer iron beam 10*b*, a right end of the bottom iron yoke 17 connects to a bottom end of the Phase-C main transformer iron beam 10*c*. A left bottom portion of the middle iron yoke 16 connects to an upper end of the Phase-A main transformer iron beam 10*a*, while a left upper portion of the middle iron yoke 16 connects to a bottom end of the Phase-C independent iron yoke 12. The upper end of the Phase-C independent iron yoke 12 connects to a left end of the Phase-C isolation transformer iron beam 11*c*. A right bottom portion of the middle iron yoke 16 connects to an upper end of the Phase-C main transformer iron beam 10*c*, while a right upper portion of the middle iron yoke 16 connects to a bottom end of the Phase-B independent iron yoke 15. The upper end of the Phase-B independent iron yoke 15 connects to a right end of the Phase-B isolation transformer iron beam 11*b*. A middle bottom portion of the middle iron yoke 16 connects to an upper end of the Phase-B main transformer iron beam 10*b*, ⅓ of the upper portion of the middle iron yoke 16 connects to the bottom end of the C/A phase common iron yoke 13, and ⅔ of the upper portion of the middle iron yoke 16 connects to the bottom end of the A/B phase common iron yoke 14. A right end of the Phase-C isolation transformer iron beam 11*c* connects to the left end of the Phase-A isolation transformer iron beam 11*a*. Both the Phase-C isolation transformer iron beam 11*c* and the Phase-A isolation transformer iron beam 11*a* connect with the upper end of the C/A phase common iron yoke 13. The left end of the Phase-B isolation transformer iron beam 11*b* connects to the right end of the Phase-A isolation transformer iron beam 11*a*. Both the Phase-B isolation transformer iron beam 11*b* and the Phase-A isolation transformer iron beam 11*a* connect to the upper end of the A/B phase common iron yoke 14.

The Phase-A secondary winding 2*a*, the Phase-A primary winding 1*a* and the Phase-A control winding 3*a* are layer-windings and concentrically wound around the Phase-A main transformer iron beam 10*a* from inside to outside. The Phase-A main transformer leakage magnetic core 6*a* is arranged at a left window of the main transformer and inserted between the Phase-A primary winding 1*a* and the Phase-A control winding 3*a*. The Phase-B secondary winding 2*b*, the Phase-B primary winding 1*b* and the Phase-B control winding 3*b* are layer-windings and concentrically wound around the Phase-B main transformer iron beam 10*b* from inside to outside. The Phase-B main transformer leakage magnetic core contains two parts, namely, a left Phase-B main transformer leakage magnetic core 6*b*1 and a right Phase-B main transformer leakage magnetic core 6*b*2. Both of them are inserted between the Phase-B primary winding 1*b* and the Phase-B control winding 3*b*, wherein: the left Phase-B main transformer leakage magnetic core 6*b*1 is arranged at the left window of the main transformer. While the right Phase-B main transformer leakage magnetic core 6*b*2 is arranged at a right window of the main transformer. The left Phase-B main transformer leakage magnetic core 6*b*1 and the right Phase-B main transformer leakage magnetic core 6*b*2 are symmetrically distributed around the Phase-B main transformer iron beam 10*b*. The Phase-C secondary winding 2*c*, the Phase-C primary winding 1*c* and the Phase-C control winding 3*c* are layer-windings and concentrically wound around the Phase-C main transformer iron beam 10*c* from inside to outside. The Phase-C main transformer leakage magnetic core 6*c* is arranged at the right window of the main transformer and inserted between the Phase-C primary winding 1*c* and the Phase-C control winding 3*c*.

The Phase-C converter side winding 4*c* and the Phase-C grid side winding 5*c* are pancake windings and concentrically wound around the Phase-C isolation transformer iron beam 11*c* from left to right. The Phase-C isolation transformer leakage magnetic core 18*c* is sandwiched between the Phase-C converter side winding 4*c* and the Phase-C grid side winding 5*c*. The Phase-A converter side winding 4*a* and the Phase-A grid side winding 5*a* are pancake windings and concentrically wound around the Phase-A isolation transformer iron beam 11*a* from left to right. The Phase-A isolation transformer leakage magnetic core 18*a* is sandwiched between the Phase-A converter side winding 4*a* and the Phase-A grid side winding 5*a*. The Phase-B converter side winding 4*b* and the Phase-B grid side winding 5*b* are pancake windings and concentrically wound around the Phase-B isolation transformer iron beam 11*b* from left to right. The Phase-B isolation transformer leakage magnetic core 18*b* is sandwiched between the Phase-B converter side winding 4*b* and the Phase-B grid side winding 5*b*.

Figure 4A:
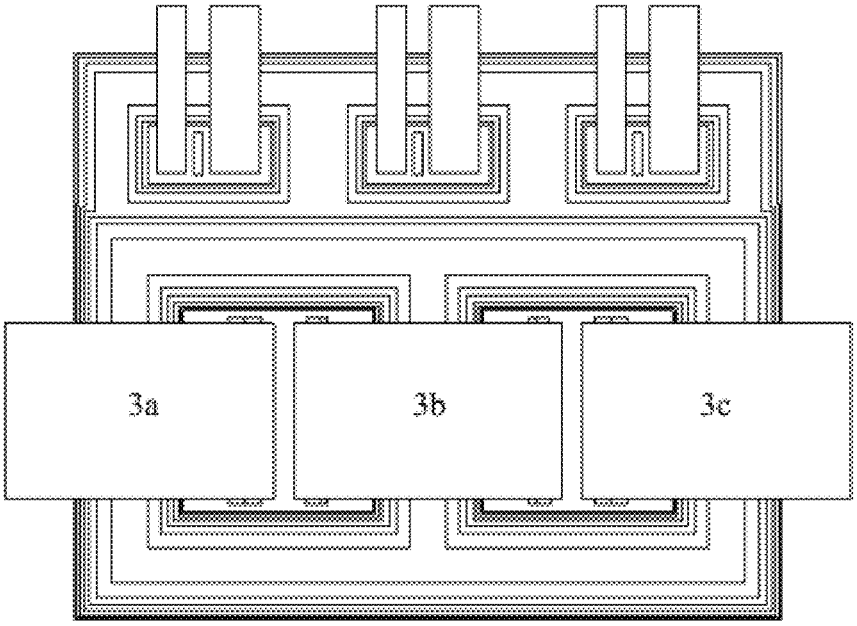
FIG. 4(*a*) is a main view of the magnetic integrated hybrid distribution transformer provided by the present invention.
Figure 4B:
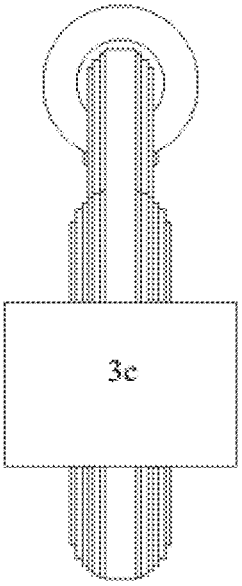
Figure 4C:
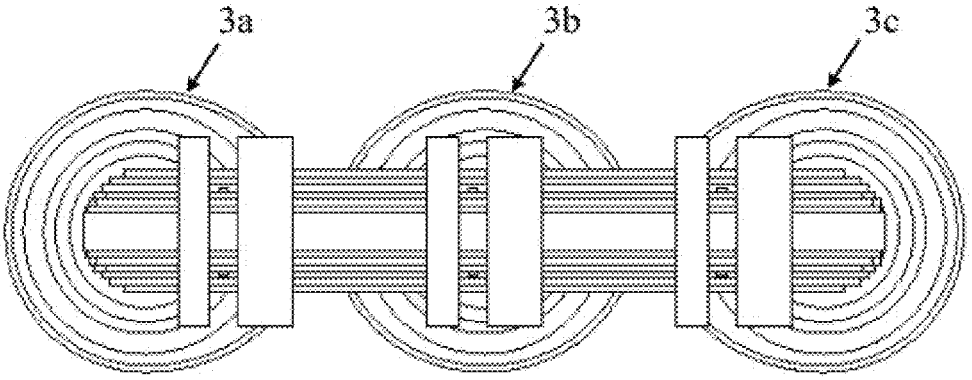

As shown in FIG. 2, each iron yoke is in 45-degree connection with a corresponding iron beam (formed by laminations). FIG. 4(*b*) shows that the sizes of the Phase-A main transformer iron beam, the Phase-B main transformer iron beam, the Phase-C main transformer iron beam, the bottom iron yoke and the middle iron yoke are larger than sizes of the Phase-A isolation transformer iron beam, the Phase-B isolation transformer iron beam, the Phase-C isolation transformer iron beam, the C/A phase common iron yoke, and the A/B phase common iron yoke, which is beneficial for making full use of ferromagnetic materials. As shown in FIG. 4(*a*), air gaps between main transformer leakage magnetic cores and the middle/bottom iron yokes or between the isolation transformer leakage magnetic cores and the middle iron yoke/isolation transformer iron beam are adjustable, which contributes to flexible adjustment of leakage inductance.

Referring to FIG. 4(*c*), a horizontal cross section of the Phase-A control winding 3*a* and the Phase-C control winding 3*c* is a combination of semicircle and ellipse, the horizontal cross section is an ellipse in the window of the main transformer and is a semicircle at an outer side of the window. A horizontal cross section of the Phase-B control winding 3*b* is completely elliptical. The elliptical and semi-elliptical windings not only provide sufficient space for the leakage magnetic core unit, but also reduce the circumference of the wire when the coil is wound, thereby saving materials.

By controlling each bridge arm of the converter 22, the load voltage and the grid current can be controlled. For example, by controlling the current of the three-phase current converter, the harmful components such as harmonic, asymmetric, and negative components in the load current are compensated in real time. Based on the principle of the three-winding transformer, the grid currents are controlled to be sinusoidal, symmetric and unity power factor. By controlling the voltage of the three-phase voltage converter, the fluctuation, distortion and asymmetric components in the grid voltage are compensated in real time, so that the load voltage can be kept as a symmetric and stable sine wave.

What is claimed is:

1. A magnetic integrated hybrid distribution transformer, comprising an iron core, windings and a converter (22), wherein: the iron core comprises an iron beam unit, an iron yoke unit and a leakage magnetic core unit; the iron beam unit comprises three main transformer iron beams and three isolation transformer iron beams that connect with each other sequentially; the iron yoke unit comprises a bottom iron yoke (17), a middle iron yoke (16) and four connection iron yokes; the leakage magnetic core unit comprises four control winding leakage magnetic cores and three converter side winding leakage magnetic cores; the windings comprise main transformer windings and series isolation transformer windings; in each phase, the main transformer windings are a control winding, a primary winding and a secondary winding all of which are wrapped around a corresponding main transformer iron beam; in each phase, the series isolation transformer windings are a grid side winding and a converter winding both of which are wrapped around a corresponding isolation transformer iron beam; each main transformer iron beam connects to the bottom iron yoke (17) and the middle iron yoke (16); each connection iron yoke connects to the middle iron yoke (16) and an end of the corresponding series isolation transformer iron beam; the main transformer iron beams and the isolation transformer iron beams form two main transformer windows and three series isolation transformer windows by sharing the middle iron yoke (16); the control winding leakage magnetic cores are respectively inserted between primary windings and control windings within two main transformer windows; the converter side winding leakage magnetic cores are respectively inserted between converter side windings and grid side windings within the three series isolation transformer windows; the converter (22) connects to the control windings and converter side windings.

2. The magnetic integrated hybrid distribution transformer, as recited in claim 1, wherein: in each phase, the primary winding connects with the grid side winding in series, grid side windings connect to a power network by a star connection with neutral point; secondary windings supply load by a three-phase four-wire methods; in each phase, the control winding and the converter side winding connect to the converter (22) by the star connection with neutral point.

3. The magnetic integrated hybrid distribution transformer, as recited in claim 1, wherein: the converter (22) comprises current bridge arms, voltage bridge arms, a zero sequence bridge arm and a DC-link (direct current-link) capacitor all of which connect with each other in parallel, the control windings are respectively connected with middle points of the current bridge arms, the converter side windings are respectively connected with middle points of the voltage bridge arms, end points of control windings and converter side windings connect to a middle point of the zero sequence bridge arm.

4. The magnetic integrated hybrid distribution transformer, as recited in claim 1, wherein: the secondary winding, the primary winding and the control winding in each phase are layer-windings all of which are concentrically wound around the corresponding main transformer iron beam from inside to outside; the converter side winding and the grid side winding in each phase are pancake windings both of which are concentrically wound around the corresponding phase isolation transformer iron beam from left to right.

5. The magnetic integrated hybrid distribution transformer, as recited in claim 1, wherein: a bottom end of the main transformer iron beams connects to the bottom iron yoke (17), an upper end of the main transformer iron beams connects to the middle iron yoke (16); ends of the isolation transformer iron beams connect to an upper end of the four connection iron yokes in sequence, two adjacent isolation transformer iron beams share a common connection iron yoke, and a bottom end of the four connection iron yokes connects to the middle iron yoke (16).

6. The magnetic integrated hybrid distribution transformer, as recited in claim 1, wherein: a phase shift arrangement is adopted in the main transformer windings and the series isolation transformer windings.

7. The magnetic integrated hybrid distribution transformer, as recited in claim 6, wherein: the main transformer windings are respectively arranged on three main transformer iron beams as an order of Phase-A, Phase-B and Phase-C from left to right, the series isolation transformer windings are respectively arranged on three isolation transformer iron beams as an order of Phase-C, Phase-B and Phase-A from left to right.

8. The magnetic integrated hybrid distribution transformer, as recited in claim 1, wherein: each iron yoke is in 45-degree connection with a corresponding iron beam, lamination of the main transformer iron beams is larger than that of the isolation transformer iron beams, and lamination of the bottom iron yoke (17) and the middle iron yoke (16) is larger than that of the connection iron yokes.

9. The magnetic integrated hybrid distribution transformer, as recited in claim 8, wherein: the lamination of the iron core is a silicon steel sheet.

10. The magnetic integrated hybrid distribution transformer, as recited in claim 1, wherein: air gaps between the control winding leakage magnetic core and one of the middle iron yoke (16) and the bottom iron yoke (17) or between the converter side winding leakage magnetic core and one of the middle iron yoke (16) and the isolation transformer iron beam are adjustable; the control windings are elliptic or semi-elliptic.

11. The magnetic integrated hybrid distribution transformer, as recited in claim 2, wherein: the converter (22) comprises current bridge arms, voltage bridge arms, a zero sequence bridge arm and a DC-link (direct current-link) capacitor all of which connect with each other in parallel, the control windings are respectively connected with middle points of the current bridge arms, the converter side windings are respectively connected with middle points of the voltage bridge arms, end points of control windings and converter side windings connect to a middle point of the zero sequence bridge arm.

* * * * *